US006481351B1

(12) United States Patent
Edinger et al.

(10) Patent No.: US 6,481,351 B1
(45) Date of Patent: Nov. 19, 2002

(54) METHOD AND DEVICE FOR THE FEED OF PRINTING PLATES

(75) Inventors: Holger Edinger, Eppelheim; Rudolf Hutzenlaub, Mannheim, both of (DE)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 09/531,345

(22) Filed: Mar. 20, 2000

(30) Foreign Application Priority Data

Mar. 19, 1999 (DE) ..... 199 12 539

(51) Int. Cl.[7] ..... B41F 27/12
(52) U.S. Cl. ..... 101/477
(58) Field of Search ..... 101/477, 415.1, 101/378

(56) References Cited

U.S. PATENT DOCUMENTS 5,127,328 A * 7/1992 Wieland ..... 101/415.1
5,331,892 A * 7/1994 Seib et al. ..... 101/415.1
5,479,859 A 1/1996 Lindner et al. ..... 101/485
5,483,892 A 1/1996 Stiel ..... 101/477
5,555,810 A * 9/1996 Stiel ..... 101/477
5,715,752 A * 2/1998 Rother et al. ..... 101/415.1
5,868,072 A * 2/1999 Nishi ..... 101/415.1

FOREIGN PATENT DOCUMENTS

DE 41 40 413 C2 6/1993
DE 42 31 901 C2 3/1994
DE 43 38 664 C2 5/1995
EP 0 431 575 B1 6/1991
JP 11-34469 A * 2/1999

* cited by examiner

*Primary Examiner*—Daniel J. Colilla
(74) *Attorney, Agent, or Firm*—Laurence A. Greenberg; Werner H. Stemer; Gregory L. Mayback

(57) ABSTRACT

A method and apparatus for feeding printing plates to a tensioning device of a plate cylinder of a printing press includes subjecting a front region of a printing plate to flexion to orient a leading edge of the printing plate essentially parallel to tensioning surfaces of a leading-edge tensioner for insertion into the leading-edge tensioner, and inserting the printing plate into the leading-edge tensioner and attaching the printing plate at the plate cylinder.

12 Claims, 5 Drawing Sheets

PRIOR ART

METHOD AND DEVICE FOR THE FEED OF PRINTING PLATES

BACKGROUND OF THE INVENTION

Field of the Invention

The invention lies in the field of printing. The invention relates to a method for the feed of printing plates to the tensioning device of a plate cylinder, the printing plates being supplied, inserted into a leading-edge tensioner, and attached to the plate cylinder. The invention relates, furthermore, to a printing-plate feed device for carrying out the method having a printing-plate supplier with a holding device for the printing plates.

European Patent 0 431 575 B1 discloses a printing plate feed method and device. In such printing-plate feeds, there is a problem that the machine geometries do not make it possible, or make it possible only at unjustifiable outlay, to supply printing plates, with a printing-plate supplier, in parallel with the tensioning surfaces of the leading-edge tensioner and to insert the printing plates into the leading-edge tensioner. After being deflected into the leading-edge tensioner by an introduction slope, the leading edge of the printing plates impinges onto the tensioning surface. However, the tensioning surfaces are, preferably, roughened, for example, by sandblasting, in order to achieve a better hold during the tensioning of the printing plates. Accordingly, the printing-plate leading edges catch on the tensioning surfaces, thus preventing any further feeding of a printing-plate. If already used printing plates are employed again, the catching problem is aggravated because the printing plates have, in their front region, a bend that was caused from the previous tension-mounting. As a result, the printing plate impinges onto the tensioning surface at an even steeper angle, becomes caught, and yields in the direction of the bend. Although the above mentioned publication discloses a roller that presses the printing plates against the plate cylinder when they are being attached to the plate cylinder, and a further roller that inserts the trailing edges of the printing plates into a trailing-edge tensioner, the rollers do not solve the problem mentioned because they do not serve for tension-mounting in the leading-edge tensioner.

SUMMARY OF THE INVENTION

It is accordingly an object of the invention to provide a method and device for the feed of printing plates that overcomes the hereinafore-mentioned disadvantages of the heretofore-known methods and devices of this general type and that reliably and easily inserts the printing plates into the leading-edge tensioner.

With the foregoing and other objects in view, there is provided, in accordance with the invention, a method for feeding printing plates to a tensioning device of a plate cylinder of a printing press including subjecting a front region of a printing plate to flexion to orient a leading edge of the printing plate essentially parallel to tensioning surfaces of a leading-edge tensioner for insertion into the leading-edge tensioner, and inserting the printing plate into the leading-edge tensioner and attaching the printing plate at the plate cylinder.

The object is achieved according to the method of the invention, in that a printing plate is subjected, in its front region, to flexion such that, for insertion, the leading edge of the printing plate is oriented essentially parallel to the tensioning surfaces of the leading-edge tensioner.

The flexion to be achieved must make possible easy insertion of the printing-plate leading edge into the gap between the two tensioning surfaces and, at the same time, if possible, not having the leading edge impinge onto any of the tensioning surfaces. The invention functions, however, even in the case of impingement at a very low angle—in other words, when the printing-plate leading edge is essentially parallel to the tensioning surfaces. The fact that the invention functions even in a range of insignificant deviations from parallelism creates the advantage for omitting an individual setting for new and used printing plates. The range is important even when the insertion of the printing plate into the leading-edge tensioner is brought about by the plate cylinder being rotated backward and the leading edge thereby being received in the clamping surfaces. Due to such rotation, the angular position of the clamping surfaces changes, and, because of such change, a particular tolerance range in the orientation of the printing-plate leading edge is also necessary. The change in the angular position could, of course, also be taken into account by a change in flexion during the insertion operation, but, as a rule, it is not necessary due to the tolerance range mentioned.

The printing-plate supplier may be fully automatic or semi-automatic. It may serve for supplying one or more printing plates. The printing-plate flexing roller may be a continuous roller, or it may include a plurality of simultaneously actuable rollers. A roller over the entire width of the printing plate and having elastic rings is also possible.

There is a large series of possibilities for holding the printing plate and subjecting it to flexion. For example, in order to carry out the method, a curved guide could be provided or a plurality of suction elements could subject the printing plate to flexion. The printing-plate flexing roller proposed by the device may cooperate with guides, suction elements, or stops as holding devices.

In accordance with another mode of the invention, there are provided the steps of orienting the printing plate parallel to the leading-edge tensioner and holding it in the orientation, and positioning the leading edge of the printing plate in front of the leading-edge tensioner.

In one development of the method, the printing plate is oriented parallel to the leading-edge tensioner and is held in the orientation. The leading edge of the printing plate is then positioned in front of the leading-edge tensioner and is subjected to flexion, in order thereafter to insert the leading edge into the leading-edge tensioner. Flexion is achieved in that, on one hand, the printing plate is held in its rear and middle regions and comes to bear on the plate cylinder in front of the leading-edge tensioner, and, on the other hand, the printing plate is subjected to flexion in the direction of the plate cylinder between the bearing point and the holding point. Orientation parallel to the tensioning surfaces of the leading-edge tensioner is thereby achieved. The orientation is carried out for both new and used printing plates. Where used printing plates are concerned, the printing plates are subjected to flexion at their bending point. Subjecting the printing plate to flexion first eliminates the bending point, and the printing plate is thereafter flexed further until an orientation parallel to the tensioning surfaces of the leading-edge tensioner is achieved.

In accordance with a further mode of the invention, the inserting step includes inserting the leading edge of the printing plate by rotating the plate cylinder backward. Due to the backward rotation, the leading-edge tensioner receives the printing plate located in front of it. The printing plate is subsequently tension-mounted and attached to the plate cylinder.

With the objects of the invention in view, there is also provided a printing-plate feed device for feeding printing plates to a tensioning device of a plate cylinder of a printing press including a leading-edge tensioner disposed on a plate cylinder of a printing press and having tensioning jaws with tensioning surfaces, a printing-plate supplier with a holding device for holding a printing plate and supplying the printing plate to the leading-edge tensioner, the printing plate having a leading edge, and at least one printing-plate flexing roller subjecting a printing plate, supplied for insertion in front of the tensioning jaws, to flexion to orient the leading edge of the printing plate essentially parallel to the tensioning surfaces.

The object is achieved with the device of the invention, in that at least one printing-plate flexing roller is provided that subjects the printing plate (supplied for insertion upstream of the tensioning jaws of the leading-edge tensioner) to flexion such that the printing plate is oriented, at its leading edge, essentially parallel to the tensioning surfaces of the tensioning jaws.

In accordance with an added feature of the invention, there is provided an introduction roller holding the leading edge of the printing plate when the printing plate is subjected to flexion.

The holding takes place at the region where the printing plate bears on the plate cylinder, the region already having been described above.

In accordance with an additional feature of the invention, the printing plate has a front region, and the at least one printing-plate flexing roller has an adjuster flexing the front region of the printing plate.

The adjuster is pressed against the front region somewhat distant from the leading edge of the printing plate in order to achieve flexion. The adjuster may have a control that cooperates with a sensor detecting the leading edge.

Preferably, however, it is sufficient to have an adjustment to set a flexion range such that both new and old printing plates can be introduced reliably into the leading-edge tensioner.

In accordance with yet another feature of the invention, the adjuster has an actively actuable actuating member, for example, pneumatic cylinders, magnetic units, or vacuum cylinders. Other possibilities may, of course, also be envisaged.

In accordance with yet a further feature of the invention, there are provided levers actuating the adjuster, the levers activated by positioning the printing-plate supplier on the plate cylinder.

The adjuster is actuable through levers that are activated by a positioning of the printing-plate supplier on the plate cylinder. The levers may be actuable through a mechanism that is activated by the placing of running rollers of the printing-plate supplier onto bearer rings of the plate cylinder. The advantage is that there is no need for separate drives and a malfunction is virtually ruled out. Moreover, index pins, which serve for orienting the printing plate in the printing-plate supplier, can be brought out of engagement through the mechanism. Additionally, the mechanism can bring the introduction roller into its holding positions for the leading edge of the printing plate. The introduction roller may, however, also be connected fixedly to the printing-plate supplier. The mechanism guarantees the cooperation of these elements in time and space in order to achieve the intended purpose, once-only adjustment during the assembly of the machine usually being sufficient.

In accordance with yet an added feature of the invention, the printing-plate supplier has running rollers and the plate cylinder has bearer rings, and there is provided a mechanism actuating the levers, the mechanism activated by placing the running rollers onto the bearer rings of the plate cylinder.

In accordance with yet an additional feature of the invention, there are provided index pins orienting the printing plate in the printing-plate supplier, the mechanism connected to and activating the index pins.

In accordance with again another feature of the invention, there is provided an introduction roller holding the leading edge of the printing plate when the printing plate is subjected to flexion, the mechanism activating the introduction roller into a holding position for the leading edge of the printing plate.

In accordance with again a further feature of the invention, there is provided an introduction roller holding the leading edge of the printing plate when the printing plate is subjected to flexion, the mechanism activating the introduction roller into a holding position for the leading edge of the printing plate.

Expediently, the mechanism resets the actuated elements into their initial position when the printing-plate supplier leaves its position for the printing-plate feed. The actuable elements can include the printing-plate flexing roller and possibly also the index pins and/or the introduction roller.

In accordance with again an added feature of the invention, there are provided index pins orienting the printing plate in the printing-plate supplier, and wherein the mechanism resets at least one of the at least one printing-plate flexing roller, the introduction roller, and the index pins into an initial position when the printing-plate supplier leaves a printing-plate feed position.

In accordance with again an additional feature of the invention, the mechanism resets the at least one printing-plate flexing roller into an initial position when the printing-plate supplier leaves a printing-plate feed position.

In accordance with still a further feature of the invention, the mechanism resets the introduction roller into an initial position when the printing-plate supplier leaves a printing-plate feed position.

In accordance with a concomitant feature of the invention, the mechanism resets the index pins into an initial position when the printing-plate supplier leaves a printing-plate feed position.

Other features that are considered as characteristic for the invention are set forth in the appended claims.

Although the invention is illustrated and described herein as embodied in a method and device for the feed of printing plates, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
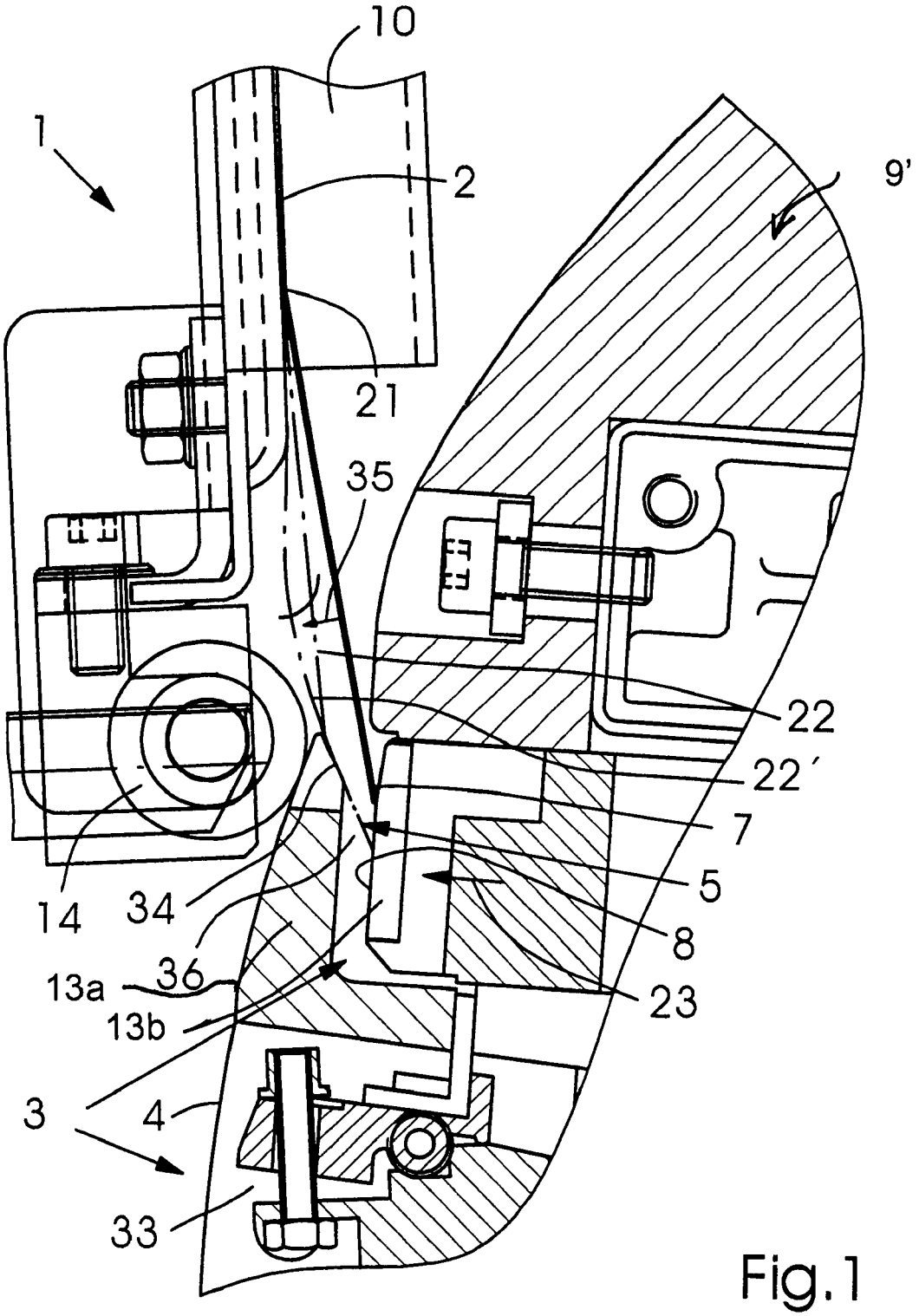
FIG. 1 is a diagrammatic, partially sectional, side elevational view of a prior art printing-plate feed device.

In all the figures of the drawing, sub-features and integral parts that correspond to one another bear the same reference symbol in each case.

Referring now to the figures of the drawings in detail and first, particularly to FIG. 1 thereof, there is shown a prior art printing-plate feed device 1. Plate cylinders 4 are equipped with a tensioning device 3 for the tension mounting of printing plates 2, a leading-edge tensioner 5 and, preferably, a trailing-edge tensioner 33. Feeding the printing plates 2 occurs as follows. A printing-plate supplier 10 is led up to the leading-edge tensioner 5 of the plate cylinder 4 such that the leading edge 7 of the printing plate 2 can be received. For reasons of geometry, it is not possible, at justifiable outlay, to supply the printing plate exactly in parallel with the tensioning surfaces 8 of the leading-edge tensioner 5. Therefore, when new printing plates 22 are being introduced, they impinge onto an introduction slope 34 and are subsequently led into the leading-edge tensioner 5. As a result, however, the printing-plate leading edge 7 is deflected and thereafter impinges onto a tensioning surface 8 of the leading-edge tensioner 5 at an angle. Because the tensioning surfaces 8 of the leading-edge tensioner 5 are roughened, for example, by sand-blasting, the leading edge 7 of the printing plate 2 cannot slide and the introduction operation fails. The dashed and dotted line 22 shows the new printing plate when it impinges onto the introduction slope 34, and the dashed and dotted line 22' shows the new printing plate 2, deflected by the introduction slope 34 when the leading edge 7 impinges onto the tensioning surface 8. The problem also arises to a substantially greater extent in the case of printing plates that have already been used once and, therefore, already have a bend 21 arising from the previous tension-mounting. The used printing plates 2 impinge with their leading edge 7 on the tensioning surface 8 of the leading-edge tensioner 5 at an even steeper angle, and the risk that the leading edge 7 will catch on the tensioning surface 8 is even greater. As a result, the printing plate is bent in the direction of the arrow 35, and the printing-plate feed can no longer be continued. Although introduction rollers 14 that insert the leading edge 7 of a printing plate 2 into the leading-edge tensioner 5 have been proposed, nevertheless such an introduction roller 14 ensures only that the leading edge 7 finds its way into the receiving slot 36. The introduction roller cannot ensure the parallel orientation of the printing-plate leading edge 7 because the introduction roller has to yield in front of the upper tensioning or clamping jaw 13*a* of the jaws 13*a*, 13*b* during the rotation 9' of the plate cylinder 4.

Figure 2:
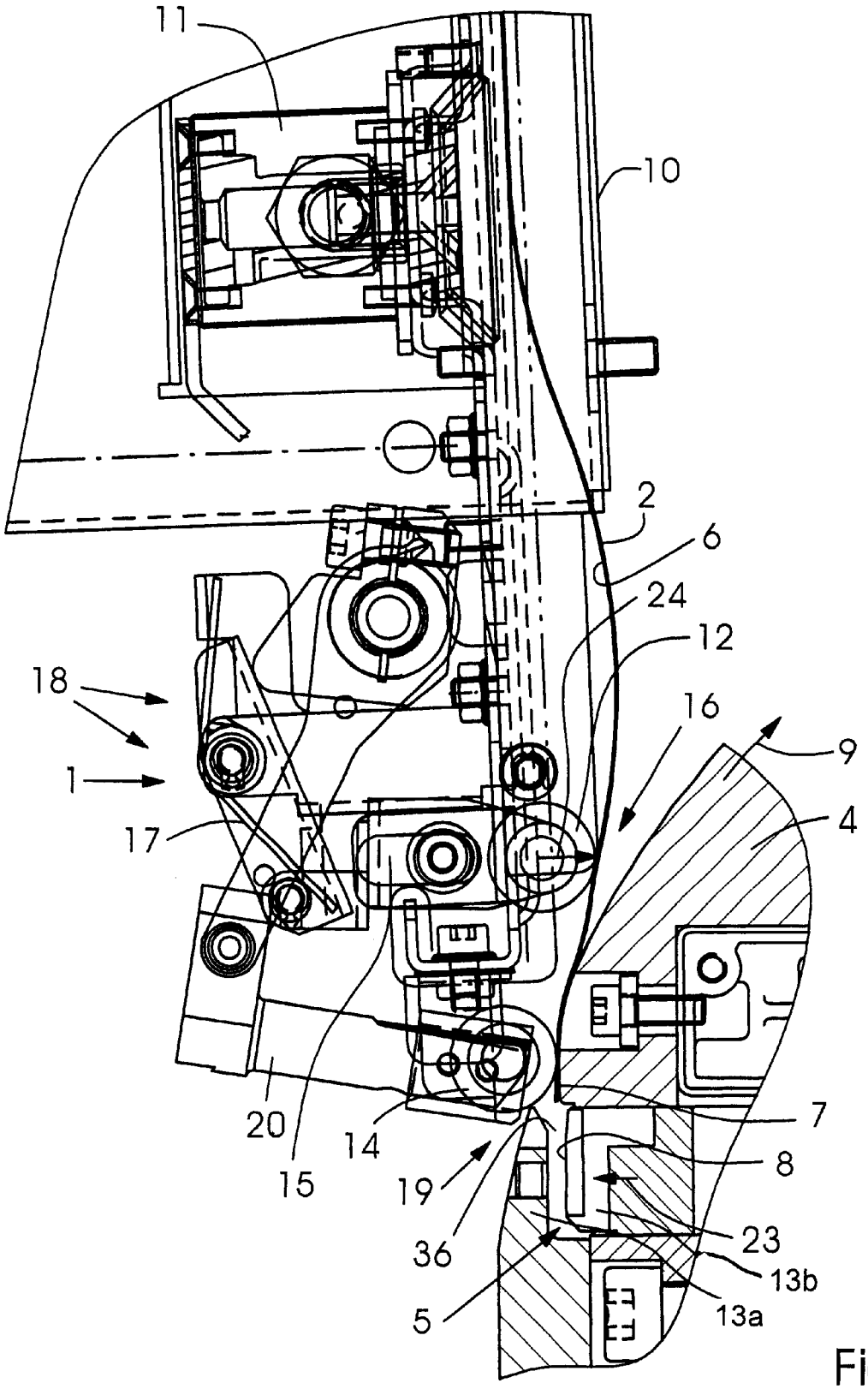
FIG. 2 is a diagrammatic, partially sectional, side elevational view of an exemplary embodiment of the invention in a first working position.
Figure 3:
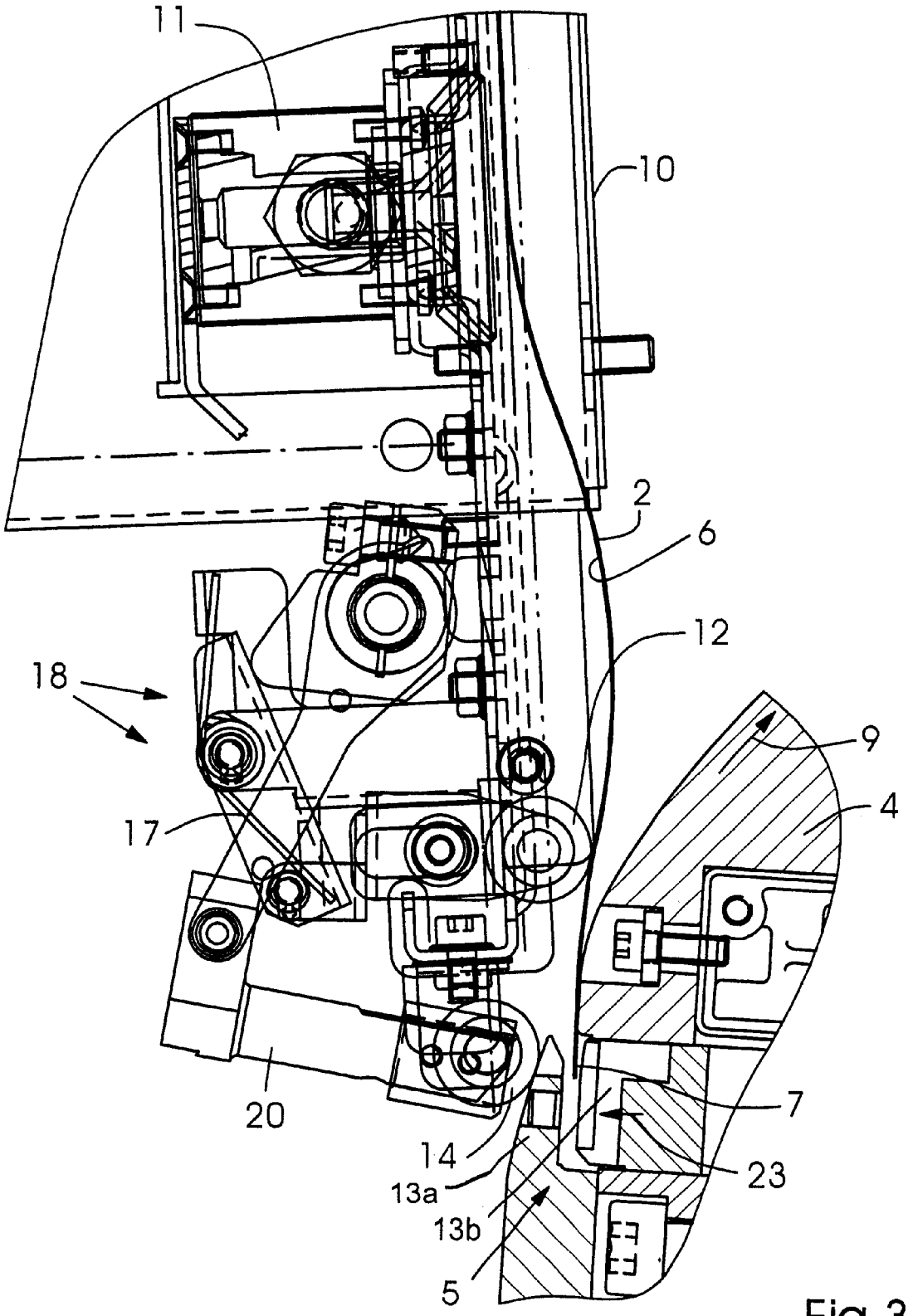
FIG. 3 is diagrammatic, partially sectional, side elevational view of FIG. 2 in a second working position.

FIG. 2 shows an exemplary embodiment of the invention. The illustration shows the position in which the printing plate 2 is led up to the leading-edge tensioner 5. In that position, the leading edge 7 of the printing plate 2 is still held by the introduction roller 14 that slides on the top side of the upper tensioning or clamping jaw 13*a* as a result of a backward rotation 9 of the plate cylinder 4, as illustrated in FIG. 3. In the position, without the measure according to the invention, the situation described with reference to FIG. 1 would arise. In order to prevent the condition, the invention provides a printing-plate flexing roller 12 that subjects the printing plate 2 to flexion 6 using an adjusting movement indicated by arrow 24 in FIG. 2. The flexion 6 results in orienting the leading edge 7 of the printing plate 2 parallel or essentially parallel to the tensioning surfaces 8 of the leading-edge tensioner 5, and allows the leading edge 7 to slide between the tensioning jaws 13, without being caught. A closing movement of the lower tensioning or clamping jaw 13*b* in the direction of the arrow 23 subsequently takes place.

In the exemplary embodiment illustrated in FIGS. 2 and 3, the printing plate 2, when subjected to flexion 6, is held by the printing-plate supplier 10 by a holding device 11. The holding device 11 may be configured, for example, as one or more lifting suckers. The leading edge 7 of the printing plate 2 bears simultaneously on the plate cylinder 4, and it may also be held by an introduction roller 14, although it is not absolutely necessary. The printing-plate flexing roller 12 impinges onto the printing plate 2 in a front region 16 somewhat distant from the leading edge 7 and, thereby, imparts flexion 6. The measure ensures that both new and old printing plates can slide satisfactorily into the leading-edge tensioner 5 because they undergo parallel orientation. Where old printing plates are concerned, the bend 21 (see FIG. 1) is first eliminated by pressure exerted by the printing-plate flexing roller 12.

Figure 4:
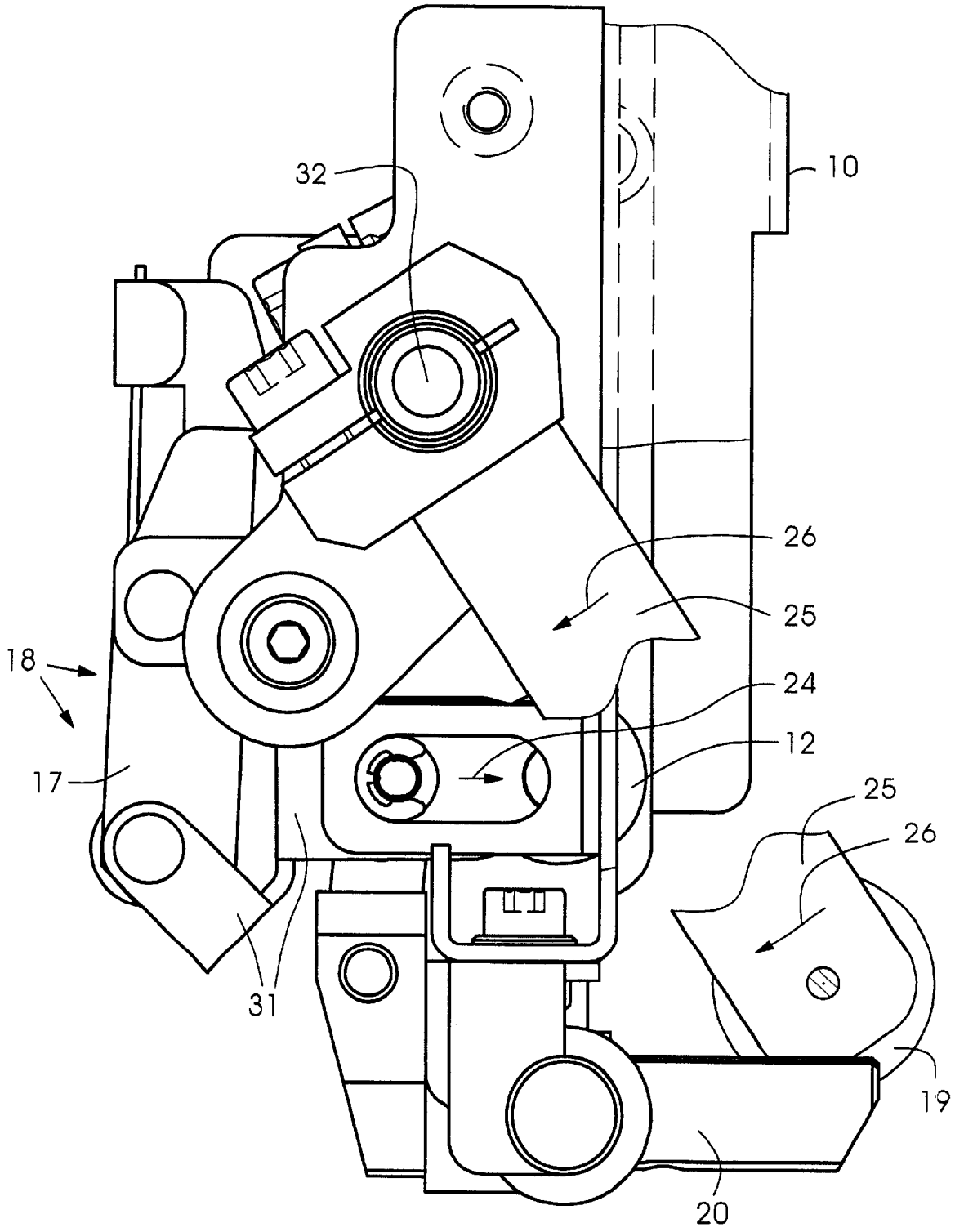
FIG. 4 is a diagrammatic, partially sectional, side elevational view of a mechanism of FIG. 2 in a first working position.
Figure 5:
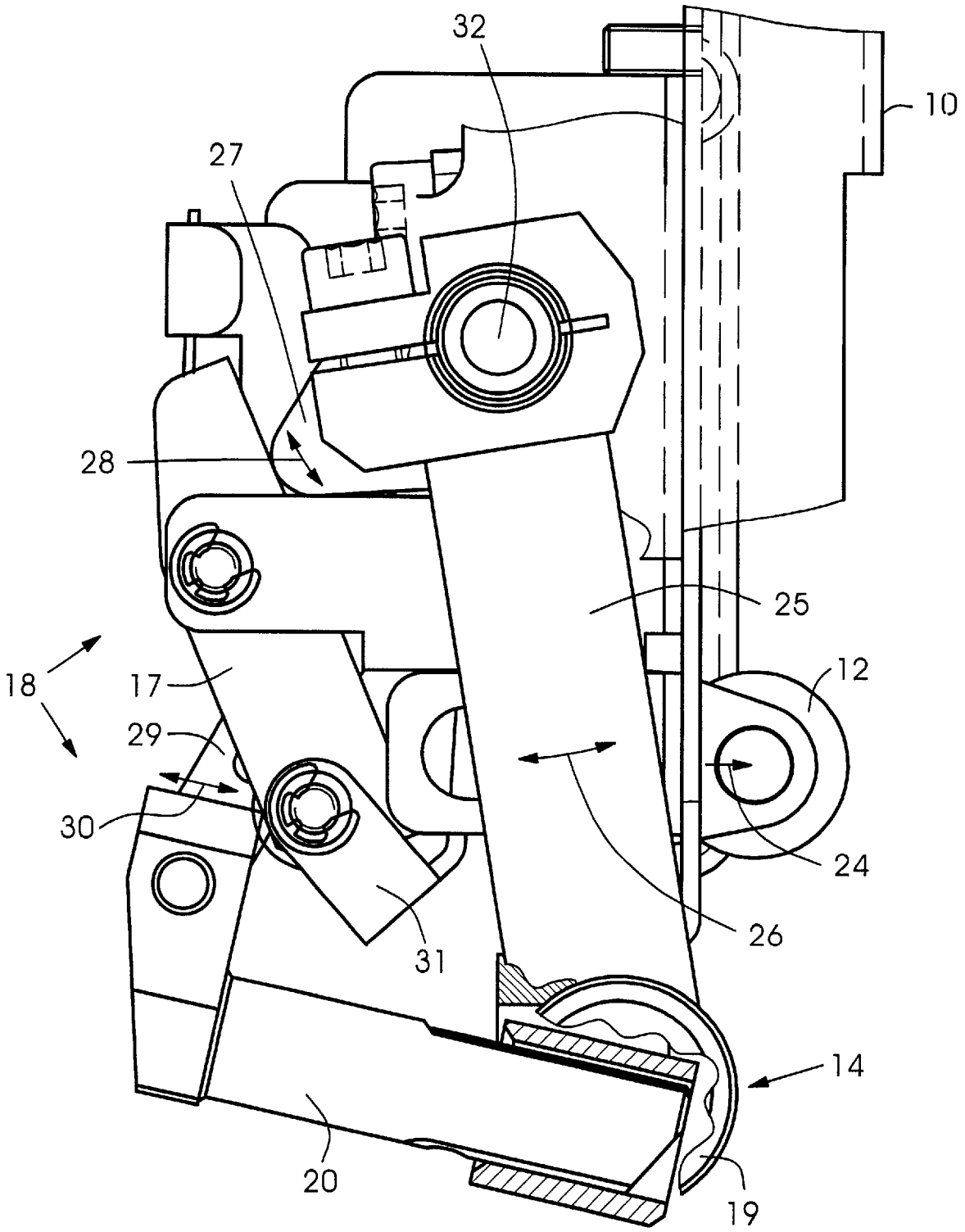
FIG. 5 is a diagrammatic, partially sectional, side elevational view of the mechanism of FIG. 4 in a second working position.

FIG. 2 also shows the mechanism 18 that brings about the adjusting movement 24 of the printing-plate flexing roller 12 through a lever 17, as soon as the running rollers 19 impinge on non-illustrated bearer rings of the plate cylinder 4. The running rollers 19 are located on both sides of the printing-plate supplier 10 on the tending side and driving side of the machine. See FIGS. 4 and 5. The running roller 19 that is disposed in front of the introduction roller 14 is omitted from FIGS. 2 and 3, and the non-illustrated other running roller 19 is located in the background behind the introduction roller 14. The running rollers 19 are mounted at the end of actuating levers 25 (FIGS. 4 and 5). The actuating levers 25 serve for actuating the mechanism 18. Index pins 20 may also be connected to the mechanism 18. The index pins 20 orient the printing plates 2, that are supplied in the printing-plate supplier 10, parallel to the leading-edge tensioner 5. During the orientation, the index pins 20 lie in recesses of the leading edge 7 of the printing plate 2 and have to be removed prior to the printing-plate feed, the position of the printing plate 2 being maintained by the holding device 11. The mechanism just described is explained in further detail below.

FIG. 3 shows the same exemplary embodiment of FIG. 2 in a second working position, in which the introduction roller 14 has been pivoted away over the upper tensioning jaw 13*a*. When the introduction roller 14 is fixedly connected to the printing-plate supplier 10, the printing-plate supplier 10 is pivoted at the same time. Such pivoting away is necessary due to the backward rotation 9 of the plate cylinder 4. Due to the backward rotation 9, the leading edge 7 of the printing plate 2 is inserted into the leading-edge tensioner 5, so that the lower tensioning jaw 13*b* can close in the direction of the arrow 23 and clamp the printing plate 2 at its leading edge 7. During the backward rotation 9 of the plate cylinder 4, the printing-plate flexing roller 12 ensures that the necessary flexion 6 is maintained and, consequently, keeps the leading edge 7 of the printing plate 2 in its orientation parallel to the tensioning surfaces 8. In the second working position, the introduction roller 14 is inoperative.

FIG. 4 shows the mechanism of the exemplary embodiment in a first working position, in which the printing-plate supplier 10 is not yet thrown onto the plate cylinder 4 and, therefore, the running rollers 19 have not yet actuated the mechanism 18. In the first working position, the index pins 20 are still in engagement, in order to position the printing plate 2 parallel to the leading-edge tensioner 5 in the printing-plate supplier 10. In the first working position, the printing-plate flexing roller 12 is still retracted and, therefore, cannot act on the printing plate 2.

FIG. 5 shows the throwing of the printing-plate supplier 10 onto the plate cylinder 4. In the position, the running rollers 19 impinge onto the bearer rings and the actuating lever 25 executes the adjusting movement of the arrow 26. As a result, the shaft 32 rotates and an eccentric 27 executes the adjusting movement 28, resulting in the actuation of the lever 17. The adjusting movement 28 is imparted through a connecting member 31 to the printing-plate flexing roller 12, which moves in the direction of the arrow 24, and thereby subjects the printing plate 2 to flexion 6. FIG. 5 shows the printing-plate flexing roller 12 after the adjusting movement 24 has been executed. Furthermore, FIG. 5 shows that the mechanism 18 also imparts the adjusting movements to the index pins 20 (preferably two). The introduction roller 14 may be connected to the printing-plate supplier 10 and, when sliding onto the upper tensioning jaw 13*a* of the leading-edge tensioner 5, pivot the leading-edge tensioner 5, or it may be disposed on other non-illustrated drivable levers or guides and move away due to spring force or be pivoted away actively. The index pins 20 are moved in the direction of the double arrow 30 through adjusting levers 29, as soon as the printing-plate supplier 10 is thrown onto the plate cylinder 4. The movement is necessary in order to release the printing plate 2 for feeding to the plate cylinder 4. The lever 29 may also be actuated by the eccentric 27 or by a further non-illustrated eccentric.

We claim:

1. A method for feeding printing plates to a tensioning device of a plate cylinder of a printing press, which comprises;

subjecting a front region of a printing plate to flexion to orient a leading edge of the printing plate substantially parallel to tensioning surfaces of a leading-edge tensioner for insertion into the leading-edge tensioner;

orienting the printing plate parallel to the leading-edge tensioner and holding the printing plate in the orientation;

positioning the leading edge of the printing plate in front of the leading-edge tensioner; and inserting the printing plate into the leading-edge tensioner by rotating the plate cylinder backward and attaching the printing plate at the plate cylinder.

2. A printing-plate feed device for feeding printing plates, having a leading edge and a front region, to a tensioning device of a plate cylinder of a printing press, comprising:

a leading-edge tensioner disposed on a plate cylinder of a printing press and having tensioning jaws with tensioning surfaces;

a printing-plate supplier with a holding device for holding a printing plate and supplying the printing plate to said leading-edge tensioner;

at least one printing-plate flexing roller subjecting a printing plate, supplied for insertion in front of said tensioning jaws, to flexion to orient the leading edge of the printing plate essentially parallel to said tensioning surfaces, said at least one printing-plate flexing roller having an adjuster flexing the front region of the printing plate; and levers actuating said adjuster, said levers activated by positioning said printing-plate supplier on the plate cylinder.

3. The printing-plate feed device according to claim 2, wherein said adjuster has an actively actuable actuating member.

4. The printing-plate feed device according to claim 2, wherein said printing-plate supplier has running rollers and the plate cylinder has bearer rings, and a mechanism actuating said levers is activated by placing said running rollers onto the bearer rings of the plate cylinder.

5. The printing-plate feed device according to claim 4, including index pins orienting the printing plate in said printing-plate supplier, said mechanism connected to and activating said index pins.

6. The printing-plate feed device according to claim 5, including an introduction roller holding the leading edge of the printing plate when the printing plate is subjected to flexion, said mechanism activating said introduction roller into a holding position for the leading edge of the printing plate.

7. The printing-plate feed device according to claim 4, including an introduction roller holding the leading edge of the printing plate when the printing plate is subjected to flexion, said mechanism activating said introduction roller into a holding position for the leading edge of the printing plate.

8. The printing-plate feed device according to claim 7, wherein said mechanism is configured to reset said introduction roller into an initial position when said printing-plate supplier leaves a printing-plate feed position.

9. The printing-plate feed device according to claim 4, including index pins orienting the printing plate in said printing-plate supplier, said mechanism resetting at least one of said at least one printing-plate flexing roller, said introduction roller, and said index pins into an initial position when said printing-plate supplier leaves a printing-plate feed position.

10. The printing-plate feed device according to claim 4, wherein said mechanism is configured to reset said at least one printing-plate flexing roller into an initial position when said printing-plate supplier leaves a printing-plate feed position.

11. The printing-plate feed device according to claim 5, wherein said mechanism is configured to reset said index pins into an initial position when said printing-plate supplier leaves a printing-plate feed position.

12. A printing-plate feed device for feeding printing plates to a tensioning device to a plate cylinder of a printing press, comprising:

a leading-edge tensioner disposed on a plate cylinder of a printing press and having tensioning jaws with tensioning surfaces;

a printing-plate supplier with a holding device for holding a printing plate and supplying the printing plate to said leading-edge tensioner, the printing plate having a leading edge;

at least one printing-plate flexing roller subjecting a printing plate, supplied for insertion in front of said tensioning jaws, to flexion to orient the leading edge of the printing plate essentially parallel to said tensioning surfaces; and an introduction roller holding the leading edge of the printing plate when the printing plate is subjected to flexion.

* * * * *